US006340955B1

(12) United States Patent
Chao

(10) Patent No.: US 6,340,955 B1
(45) Date of Patent: Jan. 22, 2002

(54) COMBINING METHOD FOR INTERNAL AND EXTERNAL INSULATING SLEEVES OF AN ANTENNA ON A COMMUNICATION INSTRUMENT

(75) Inventor: Jack Chao, Pa-Te (TW)

(73) Assignee: Auden Techno Corp. (TW)

( * ) Notice: Subject to any disclaimer, the term of this patent is extended or adjusted under 35 U.S.C. 154(b) by 0 days.

(21) Appl. No.: 09/624,549

(22) Filed: Jul. 24, 2000

(51) Int. Cl.[7] ..... H01Q 1/24
(52) U.S. Cl. ..... 343/895; 343/702; 29/600
(58) Field of Search ..... 343/702, 895, 343/900, 901; 29/715, 600; H01Q 1/36, 1/24

(56) References Cited

U.S. PATENT DOCUMENTS 6,215,446 B1 * 4/2001 Sullivan et al. ..... 343/895
6,268,836 B1 * 7/2001 Faulkner et al. ..... 343/895

* cited by examiner

*Primary Examiner*—Michael C. Wimer
(74) *Attorney, Agent, or Firm*—Troxell Law Office PLLC

(57) ABSTRACT

A method for combining an internal insulating sleeve and an external insulating sleeve of an antenna for a communication instrument, including the steps: a coil and positioning and electric connecting members are mounted in the internal insulating sleeve; the internal and external insulating sleeves are slipped one over the other, the internal insulating sleeve has a connecting section partially exposed to the outside; the internal and external insulating sleeves are closed to form a joint between them with a radial thickness for melting; the internal and the external insulating sleeves are sent into a melting machine in which the temperature for melting is set, and a transient electrical turning on for melting is done to combine the internal and external insulating sleeves integrally. The structural strength and durability of the antenna thus is largely increased.

11 Claims, 5 Drawing Sheets

COMBINING METHOD FOR INTERNAL AND EXTERNAL INSULATING SLEEVES OF AN ANTENNA ON A COMMUNICATION INSTRUMENT

BACKGROUND OF THE INVENTION

1. Field of the Invention

The present invention is related to a method for combining the internal and external insulating sleeves of an antenna for a communication instrument, and especially to a method for fast melting combining the internal and external insulating sleeves made of different material on a miniature antenna of a mobile phone in a mass production mode, this makes the combined structure more stable and reliable.

2. Description of the Prior Art

Conventional mobile phones generally are divided into a fixed and a stretchable type, no matter whichever type they are of, their antennae are destined to have the requirement to be miniaturized following the tendency of miniaturizing of the mobile phones. Particularly a fixed miniature antenna must have its electric coil, contact pieces for a receiving seat etc. densely mounted in the space between the internal and external insulating sleeves, and then the insulating sleeves can be processed for combining. Besides, although a stretchable antenna has structurally a longer stretchable antenna rod, it still has to be processed for combining of the base portion with the coil.

FIG. 1 shows a fixed miniature antenna of a mobile phone, it can be combined on the top of the mobile phone in a snap-in mode. Basically, such a fixed miniature antenna of a mobile phone is provided generally in the interior of the external insulating sleeve 10 thereof (namely, the exposed pipe of the antenna) with an internal insulating sleeve 11 for positioning therein a metallic receiving seat 12. The metallic receiving seat 12 is mounted thereon a coil 15 to cooperate with the inner upper surface 14 of the external insulating sleeve 10; while a lower portion 16 thereof can be mounted thereon an exposed elastic contact piece 17. In the presently used processing mode, the external insulating sleeve 10 having the inner upper surface 14 and a down facing opening 18 is combined with the internal insulating sleeve 11 by applying adhesive 19 therebetween after it is slipped over the internal insulating sleeve 11.

The presently used processing mode of applying adhesive between the internal and external insulating sleeves of a mobile phone has the following disadvantages:

1. The mode of applying adhesive often makes people wait for gluing, this results slow production speed, and the amount of adhesive applied and the area of gluing are uncertain, thereby, quality of combining is unstable.
2. Applying adhesive for combining at the combining areas of the internal and external insulating sleeves results inferior structural strength; they are no ideal in strength tests.
3. The chemical property of such adhesive generally may include corrosiveness; this may damage the whole antenna structure after a long period of use.

By virtue that the structural strength of the combining area between the internal and external insulating sleeves effected by the mode of applying adhesive is not as good as desired although it is faster in processing, the methods of processing available presently thereby also include injection enveloping and forming. However, the coil as stated in the above antenna structure must be uprightly held between the external insulating sleeve and the receiving seat. The method of injection enveloping and forming makes the spring coil enveloped and positioned in the interior extremely unstable, this results high rate of inferiority.

Another method of fix combining for the internal and external insulating sleeves of such an antenna is to provide a flange and a crevice respectively on the internal and external insulating sleeves to make their integral combination by press engagement. However, the structural strength of the whole antenna completed by such a combining method is still not ideal. And the speed of processing thereof is relatively slow by virtue that the flange must be pressed in the crevice.

Further, the internal and external insulating sleeves of the antennae of this kind generally are made of different material, for example, thermoplastic plastics is used for the external insulating sleeve, and polystyrene is used for the internal insulating sleeve. Thermoplastic plastics has a melting point of about 260° C.–270° C., while the melting point of polystyrene is about 190° C.–200° C., thereby, the internal and external insulating sleeves have never been combined by melting in the art.

SUMMARY OF THE INVENTION

The object of the present invention is to provide a method for combining the internal and external insulating sleeves of an antenna for a portable communication instrument. This method can make fast combining of the internal and external insulating sleeves which are slipped one over the other, the structural strength of the whole antenna completed by such a combining method is largely increased. The method of combining renders the processing faster, thereby is especially suitable for mass production, and working hour and cost of production can thus be reduced.

To obtain this object, the present invention is arranged to have the internal and the external insulating sleeves molten at their peripheries at the connecting area therebetween, then the internal and the external insulating sleeves are electrically turned on to transiently melt them together at a chosen temperature. The chosen temperature is about the value between the melting points of the two which are made of different material, while the time for the transient melting is within 1 second.

The present invention will be apparent in its novelty and other characteristics after reading the detailed description of the preferred embodiment thereof in reference to the accompanying drawings.

DETAILED DESCRIPTION OF THE PREFERRED EMBODIMENT

Figure 1:
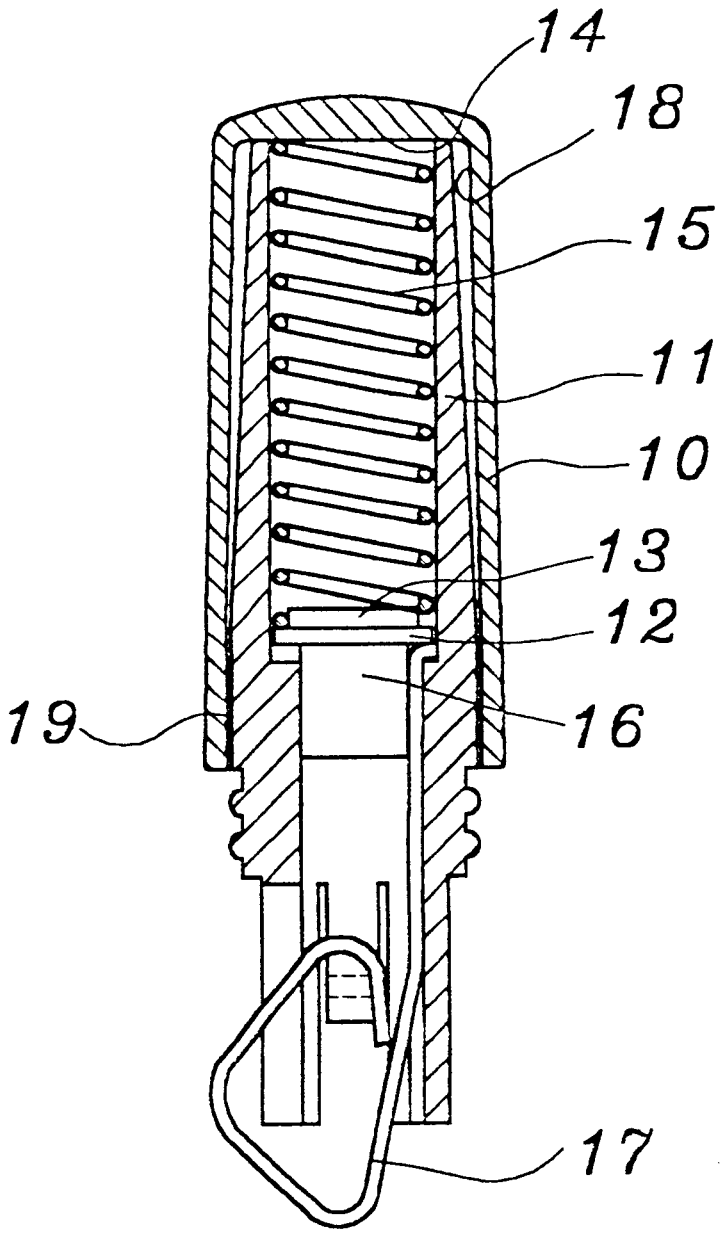
FIG. 1 PRIOR ART
FIG. 1 is a sectional view showing a conventional fixed miniature antenna of a mobile phone.
Figure 2:
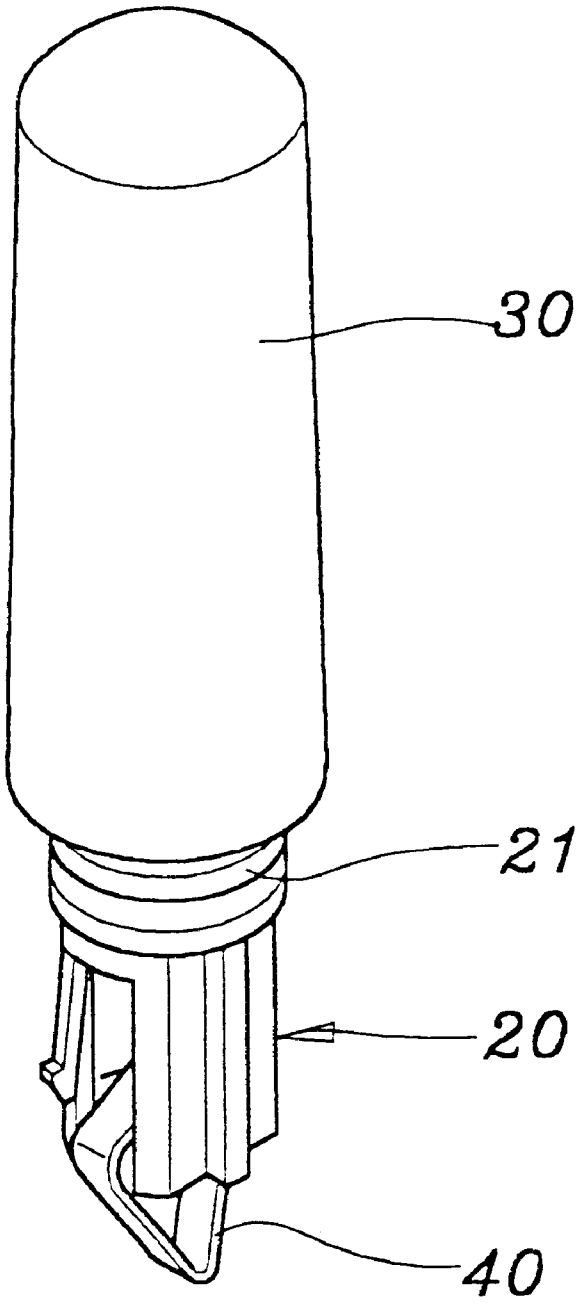
FIG. 2 is a perspective view showing a miniature antenna of the same kind made from the method of the present invention.
Figure 3:
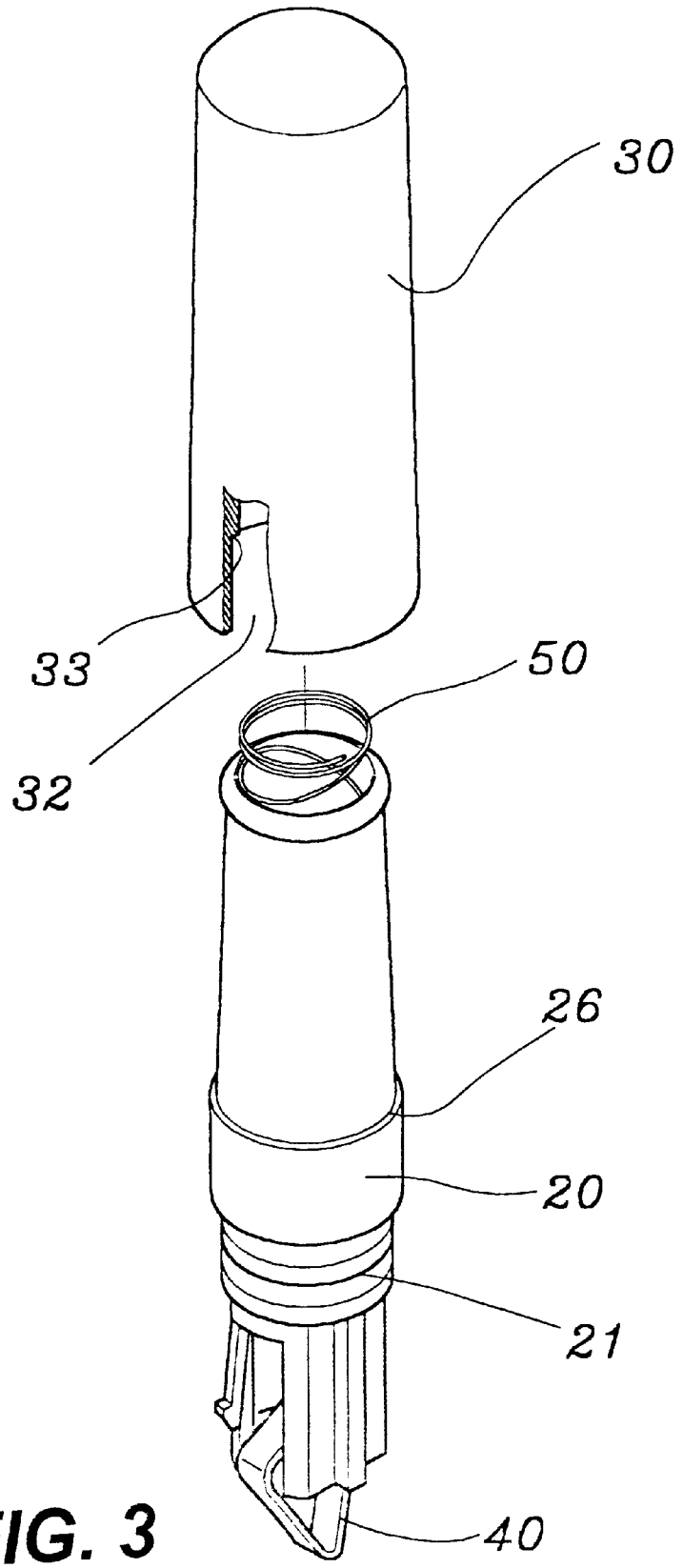
FIG. 3 is an analytic perspective view showing the internal and the external insulating sleeves and other members of FIG. 2, wherein, the external insulating sleeve is partially shown in sectional view.

Referring to FIGS. 2, 3, the fixed miniature antenna of such kind in the present invention also includes an internal insulating sleeve 20 having therein positioning and electric connecting members and capable of combining with an external insulating sleeve 30 to form the whole antenna. After combining, a threaded connecting section 21 on the internal insulating sleeve 20 and an elastic contact piece 40 are partially exposed to the outside ready for connecting the whole antenna to an inner threaded hole of the mobile phone via the threaded connecting section 21, and the elastic contact piece 40 connects with an internal electric coil 50.

In the specification below, it assumes that the internal and the external insulating sleeve 20, 30 are made of different material respectively. Polystyrene is used for the internal insulating sleeve 20, the melting point of polystyrene is about 190° C.–200° C.; while thermoplastic plastics is used for the external insulating sleeve 30, its melting point is about 260° C.–270° C.

Figure 5:
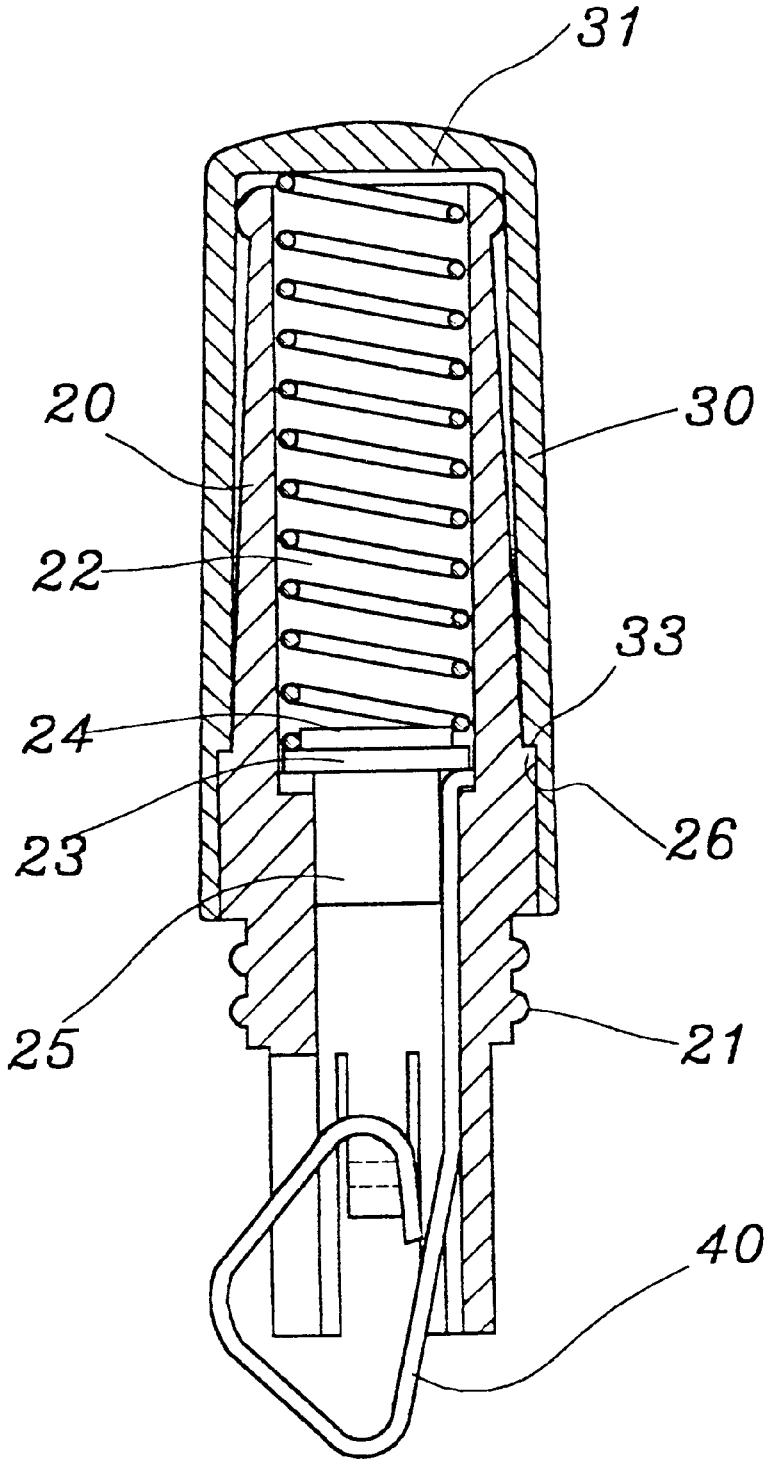
FIG. 5 is a sectional view taken from FIG. 2.

As shown in FIG. 5, an internal through hole 22 of the internal insulating sleeve 20 can be mounted with a metallic receiving seat 23 which can position on an upper surface 24 thereof a coil 50 in cooperation with an inner upper surface 31 of the external insulating sleeve 30; while a lower portion 25 thereof can make positioning of the extending-in section of an elastic contact piece 40, then the internal insulating sleeve 20 can be slipped in an down facing opening 32 of the external insulating sleeve 30, the two sleeves are in their primary positions ready for melting connection.

Figure 4:
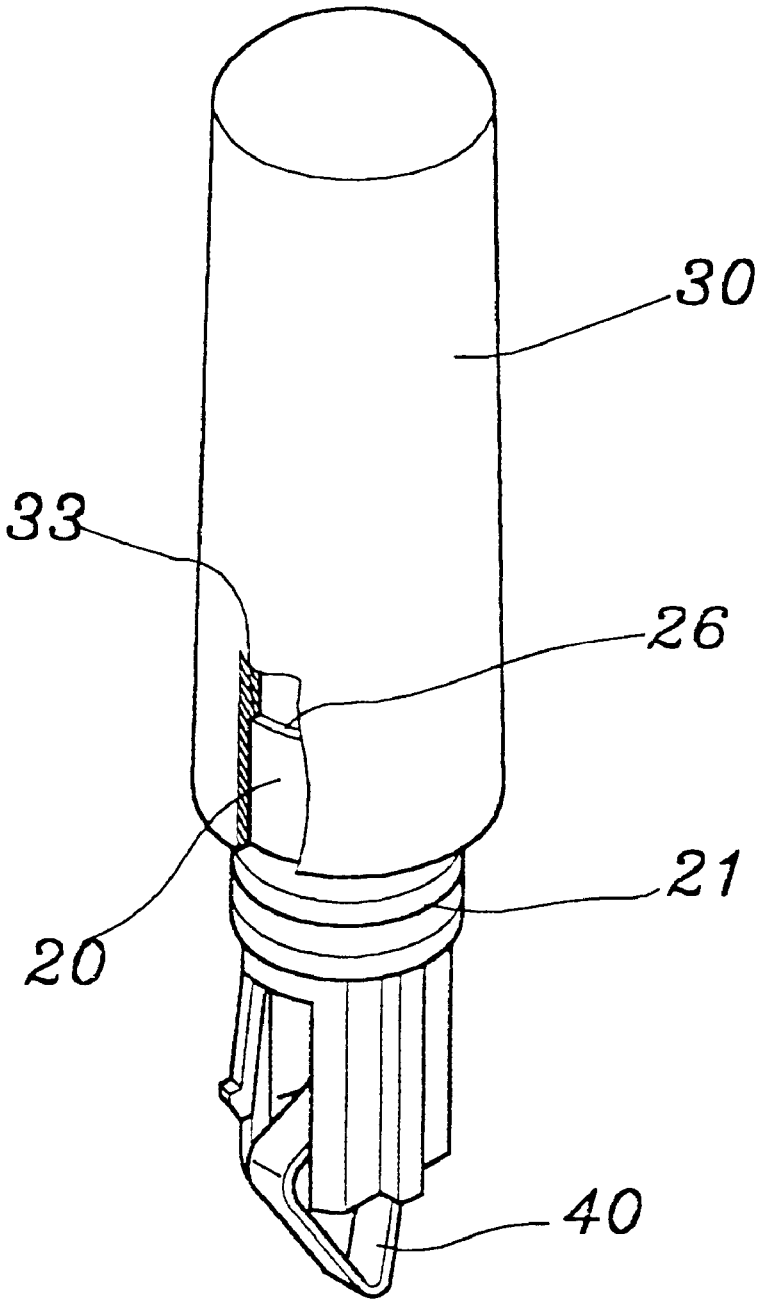
FIG. 4 is a perspective view showing the external insulating sleeve shown in FIG. 3 is combined.

In the preferred embodiment shown in FIGS. 3 and 4, the internal insulating sleeve 20 has on the shank thereof an outer stepped shoulder 26 which has a very small radial thickness. And the external insulating sleeve 30 has on the inner surface thereof an inner stepped shoulder 33. When the internal insulating sleeve 20 and the external insulating sleeve 30 are combined with each other by slipping as stated above, the inner stepped shoulder 33 is abutted against the outer stepped shoulder 26 to form a joint for melting. The inner stepped shoulder 33 and the outer stepped shoulder 26 are of small thickness, and are convenient to be connected with each other by heat melting. However, their thickness can be adjusted in pursuance of the connection strength desired. Generally, the total length of the antenna (from the top of the external insulating sleeve 30 to the bottom of the internal insulating sleeve 20 as shown in FIG. 2) is 27 mm, while the length of the external insulating sleeve 30 is 16 mm, its most external diameter is 8.7 mm, and the diameter of the exposed section of the internal insulating sleeve 20 is 5.3 mm; the radial thickness of the inner stepped shoulder 33 and the outer stepped shoulder 26 is 0.15 mm when the internal insulating sleeve 20 and the external insulating sleeve 30 are made of same material, and is the value between 0.15 mm to 0.5 mm when the two sleeves are made of different material.

As stated above, when the external insulating sleeve 30 is made of industrial plastic, and the internal insulating sleeve 20 is made of polystyrene, they can be sent into a melting machine such as a super sonic melting machine after the above stated procedure of slipping one over the other, to have the two integrally combined by melting. When the two are made of the mentioned different material, it is found in experiments that the temperature set for melting is the value about the exact middle of the two melting points thereof. That is, if the melting point of industrial plastic is 260° C.–270° C., and if the melting point of polystyrene is 190° C.–200° C., then the set temperature for melting is about 235° C. And electrical turning on for melting must be transient, i.e., the melting operation is completed in about one second. The internal insulating sleeve 20 and the external insulating sleeve 30 are integrally combined with each other by melting at the set temperature for melting and at the joint of the inner stepped shoulder 33 and the outer stepped shoulder 26 under the condition of transient turning on.

The internal insulating sleeve 20 and the external insulating sleeve 30 of the present invention are slipped one over the other primarily when the internal insulating sleeve 20 is placed therein the coil 50 and related positioning and electric connecting members, and then can be molten. In this mode, at least the following advantages are provided:

1. Assembling of the mobile phone is faster and more convenient, this is suitable especially for mass production.
2. The internal insulating sleeve and the external insulating sleeve of the mobile phone are fixedly and integrally combined with each other by melting, the strength of the whole structure is largely increased.
3. The whole antenna is more durable without using any chemical adhesive which is corrosive.
4. The process of operation is stable and reliable, quality of products can be elevated, and inferiority of products can be lowered.

The preferred embodiment cited above is only for illustrating and not for giving any limitation to the scope of the present invention. It will be apparent to those skilled in this art that various modifications or changes can be made to the elements of the present invention without departing from the spirit and scope of this invention. For example, the internal insulating sleeve and the external insulating sleeve can be made of same material, all such modifications and changes also fall within the cope of the appended claims and are intended to form part of this invention.

What is claimed is:

1. A method for combining an internal insulating sleeve and an external insulating sleeve of an antenna for a communication instrument, including the steps of:

mounting a coil, and a plurality of positioning and electric connecting members in said internal insulating sleeve;

placing said internal insulating sleeve and said external insulating sleeve one over the other, said internal insulating sleeve having a connecting section partially exposed to the outside ready for connecting to said communication instrument;

providing said internal insulating sleeve and said external insulating sleeve, respectively, with an outer stepped shoulder and an inner stepped shoulder at a joint between them with a radial thickness for melting;

heating said internal insulating sleeve and said external insulating sleeve in a melting machine for melting the inner and outer stepped shoulders to join said internal insulating sleeve and said external insulating sleeve together.

2. The method for combining an internal insulating sleeve and an external insulating sleeve of an antenna for a communication instrument as defined in claim 1, wherein said internal insulating sleeve and said external insulating sleeve are made of different kinds of material.

3. The method for combining an internal insulating sleeve and an external insulating sleeve of an antenna for a communication instrument as defined in claim 2, wherein a melting temperature in said melting machine is equal to a value in a middle of two melting points of said different kinds of material, wherein the melting operation is completed in one second.

4. The method for combining an internal insulating sleeve and an external insulating sleeve of an antenna for a communication instrument as defined in claim 3, wherein said external insulating sleeve is made of a thermoplastic material, said internal insulating sleeve is made of a polystyrene material and said melting temperature is approximately 235° C.

5. The method for combining an internal insulating sleeve and an external insulating sleeve of an antenna for a communication instrument as defined in claim 1, wherein said external and said internal insulating sleeves are made of the same material, and a melting temperature in said melting machine is approximately equal to a melting point of said material, and wherein the melting operation is completed in one second.

6. The method for combining an internal insulating sleeve and an external insulating sleeve of an antenna for a communication instrument as defined in claim 1, wherein said joint is formed by said outer and inner stepped shoulders abutting against each other.

7. The method for combining an internal insulating sleeve and an external insulating sleeve of an antenna for a communication instrument as defined in claim 6, wherein a radial thickness of said joint is between 0.15 mm and 0.5 mm.

8. The method for combining an internal insulating sleeve and an external insulating sleeve of an antenna for a communication instrument as defined in claim 2, wherein said joint is formed by said outer and inner stepped shoulders abutting against each other.

9. The method for combining an internal insulating sleeve and an external insulating sleeve of an antenna for a communication instrument as defined in claim 3, wherein said joint is formed by said outer and inner stepped shoulders abutting against each other.

10. The method for combining an internal insulating sleeve and an external insulating sleeve of an antenna for a communication instrument as defined in claim 4, wherein said joint is formed by said outer and inner stepped shoulders abutting against each other.

11. The method for combining an internal insulating sleeve and an external insulating sleeve of an antenna for a communication instrument as defined in claim 5, wherein said joint is formed by said outer and inner stepped shoulders abutting against each other.

* * * * *